United States Patent [19]

Tamura et al.

[11] Patent Number: 4,730,997

[45] Date of Patent: Mar. 15, 1988

[54] HERMETIC SCROLL COMPRESSOR HAVING CONCAVE SPACES COMMUNICATING WITH A DELIVERY PORT

[75] Inventors: Takahiro Tamura; Naoshi Uchikawa; Akira Murayama; Takao Mizuno, all of Shimizu, Japan

[73] Assignee: Hitachi, Ltd., Tokyo, Japan

[21] Appl. No.: 898,211

[22] Filed: Aug. 20, 1986

[30] Foreign Application Priority Data

Oct. 14, 1985 [JP] Japan ..... 60-226726

[51] Int. Cl.[4] ..... F04C 18/04; F04C 29/02

[52] U.S. Cl. ..... 418/55; 418/DIG. 1

[58] Field of Search ..... 418/55, 88, 94, DIG. 1; 417/902

[56] References Cited

U.S. PATENT DOCUMENTS

| | | | |
|---|---|---|---|
| 4,365,941 | 12/1982 | Tojo et al. | 418/55 |
| 4,462,772 | 7/1984 | Hazaki et al. | 418/55 |
| 4,518,324 | 5/1985 | Mizuno et al. | 418/55 |
| 4,557,675 | 12/1985 | Murayama et al. | 418/55 |

*Primary Examiner*—John J. Vrablik

*Attorney, Agent, or Firm*—Antonelli, Terry & Wands

[57] ABSTRACT

The scroll type compressor has a hermetic casing, and a scroll compressor section and an electric motor section which are contained within the hermetic casing. These compressor and electric motor sections are fitted through a frame in the hermetic casing. In a portion of the frame intermediate between the compressor and the electric motor section, a plurality of segmented concave spaces are defined. At an upper portion in the hermetic casing, a discharge space which communicates with a discharge port of the scroll compressor section is defined. Further, in a portion of the casing between the compressor and the motor section, a delivery port which open to one of the concave spaces in the frame is provided. Furthermore, at least one fluid passage is provided in an outer periphery of the compressor section and this passage makes the discharge space communicate with the other concave spaces in the frame. A compressed gas from the scroll compressor section is introduced via the discharge space and the fluid passage into the concave spaces, and is introduced from the delivery port to the outside of the compressor after separating the oil contained within the compressed gas in these concave spaces.

7 Claims, 2 Drawing Figures

HERMETIC SCROLL COMPRESSOR HAVING CONCAVE SPACES COMMUNICATING WITH A DELIVERY PORT

BACKGROUND OF THE INVENTION

The present invention relates to a hermetic scroll compressor.

In, for example, U.S. Pat. No. 4,462,772, a hermetic scroll compressor is proposed wherein a passage for refrigerant gas is formed to extend downwardly to a portion adjacent an end of a coil at the upper end of an electric motor, so that a separation of an oil, suspended by the refrigerant, is dependent upon the effect of a change in velocity of the refrigerant when the refrigerant strikes the upper end of the motor together with the effect of a reduction in the velocity of the refrigerant around an outer periphery and a lower portion of the motor. However, a disadvantage of this proposed oil separating method resides in the fact that, when the refrigerant contains a large amount of oil, oil stagnates at the upper portion of the motor and the refrigerant gas strikes against the stagnate oil thereby resulting no only in an insufficient separation of oil from the refrigerant but also an undesirable "blow up" of the oil so that an undesirable amount of lubricating oil is discharged from the hermetic scroll compressor.

SUMMARY OF THE INVENTION

An object of the present invention is to reduce the amount of oil brought out of the hermetic scroll compressor.

According to the invention a hermetic scroll compressor is provided which includes a hermetic casing, with a scroll compressor section disposed in an upper portion of the hermetic casing and including a pair of scroll members each having an end plate and a scroll wrap formed on the end plate. The scroll members are assembled so that the scroll wraps mesh with each other and closed spaces defined between the scroll wraps and the end plates are progressively decreased in volume when the spaces are moved towards a center of the compressor as a result of a relative orbiting motion between the scroll members. An electric motor section is provided for driving a scroll compressor section disposed in a lower portion of the hermetic casing an oil reservoir is formed in a bottom portion of the hermetic casing and a delivery port is formed in a portion of the hermetic casing between the compressor section and the electric motor section. At least one fluid passage is formed in an outer periphery of the compressor section and along an inner surface of a wall of the hermetic casing, so that a compressed fluid, discharged from the compressor section into a discharge space, is introduced to the delivery port through the fluid passage. The compressor section and the electric motor section are secured to a common frame so as to be fixedly mounted in the hermetic casing through the frame, with the frame having a plurality of motor mounting legs and a central main bearing boss formed on a side of the frame adjacent the electric motor section. The main bearing boss and the legs are connected through a plurality of reinforcing ribs so that the ribs, which may be radially arranged, and the legs cooperate in defining a plurality of concave spaces which are communicated with one another at their lower portions, and the delivery port is opened to one of the concave spaces while each of the other concave spaces is communicate at an upper portion thereof with at least one of the fluid passages.

Advantageously, the fluid passage may be defined as an arcuate passageway formed along the inner surface of the wall of the hermetic casing.

Furthermore, according to the present invention, the fluid passages may have different cross-sectional areas.

In accordance with still further features of the present invention, the passage may be defined as an arcuate groove formed in and along the outer peripheral surface of the compressor section.

By virtue of the above-noted features of the present invention, a hermetic scroll compressor is provided wherein the refrigerant gas, compressed to a high pressure by the operation of the compressor section, flows downwardly through the plurality of fluid passages, and the oil contained in the refrigerant is separated therefrom as the refrigerant flows toward the delivery port, with the separated oil being blocked by the radially arranged ribs so as to prevent the separated oil from reaching the delivery port. Thus, the amount of oil discharge from the hermetic casing becomes extremely small.

DETAILED DESCRIPTION OF PREFERRED EMBODIMENT

Figure 1:
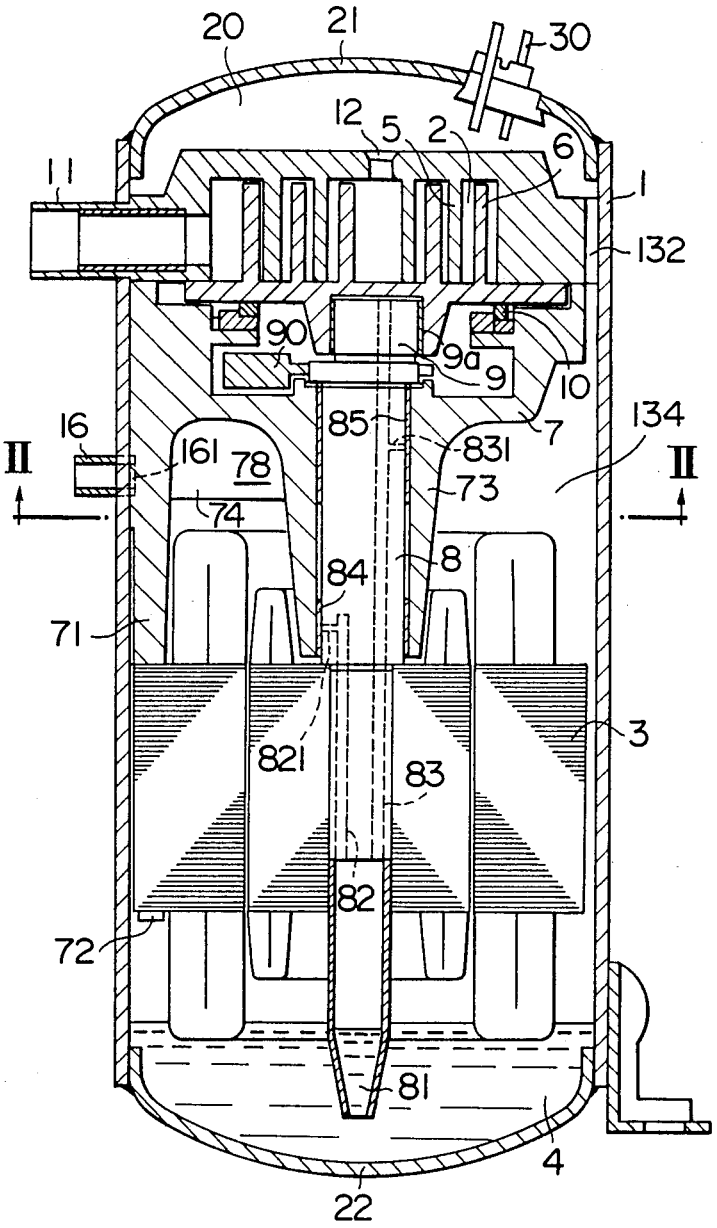
FIG. 1 is a longitudinal cross sectional view of the hermetic scroll compressor according to one embodiment of the invention.

Referring now to the drawings wherein like reference numerals are used to designate like parts and, more particularly, to FIG. 1, according to this figure, a hermetic scroll compressor includes a scroll compressor section 2, a motor section 3, a crankshaft 8 for connecting the scroll compressor section 8 and motor section 3, and a frame 7 which are housed within a hermetic casing 1. An oil reservoir, accomodating a lubricating oil, is defined by a lower cover 22 at a lower portion of the hermetic casing 1. The scroll compressor section 2 includes a stationary scroll member 5 and an orbiting scroll member 6, each having an end plate, and a scroll wrap formed thereon, with the scroll members being assembled such that their wraps mesh each other, and the frame 7, fixed with the stationary scroll member 5 and encasing the orbiting scroll member 6 while supporting the crankshaft 8. A crank 9 of the crankshaft 8 is inserted into a hole formed in a rear surface of the end plate of the orbiting scroll member 6. The crank 9 includes a revolving shaft bearing portion 9*a* and a revolving mechanism 10 for preventing the orbiting scroll member 6 from rotating about its axis. A suction pipe 11 communicating with the exterior of the casing, is connected to the stationary scroll member 5, and a discharge port 12 is provided at the central portion of the stationary scroll member 5. The compressor section 2 is press-fitted into the hermetic casing 1, while the motor section 3 is fastened by bolts 72 to the leg portion 71 of the frame 7 to be inserted into the hermetic casing 1. Furthermore, a plurality of notch-shaped fluid passages 131, 132 and 133 are provided between the compressor section 2 and the hermetic casing 1. A discharge space 20 is defined between an upper cover 21 of the hermetic casing 1 and the upper surface of the stationary scroll member 5. The discharge space 20 communicates with a space 134 via the passages 131, 132 and 133, which space 134, in turn, communicates with the delivery port 161. The leg portion 71 of the frame 7 includes a plurality of legs for mounting the motor section 3. The legs extend in the axial direction of the casing 1 and are formed in substantially the same length as a main bearing boss 73 extending from the central portion of the frame 7. A plurality of reinforcing ribs 74 are integrally formed with the boss 73 and the base ends of the legs of the leg portion 71 such that the boss 73 is connected to the legs through the reinforcing ribs 74, while at the same time defining together with the boss 73 and the legs a plurality of concave spaces 75, 76, 77 and 78 which communicate with each other at the lower portions thereof. A delivery port 161 connected to a delivery pipe 16, is opened to one space 78 of those spaces, while at least one of the passages 131, 132, and 133 is opened to the upper portion of each of the other spaces 75, 76, and 77. The passages 131, 132 and 133 have different opening areas, although they may have an equal opening area, with the passages 131, 132, 133 being arcuately provided along the surface of the inner wall of the hermetic casing 1. The passages 131, 132, 133 are formed in the form of arcuate recess in the outer peripheral surface of the compressor section 2. A terminal 30 is provided for connecting a power supply. An oil suction pipe 81, forming a portion, of an oil pump portion is connected to the lowermost portion of the crankshaft 8. The oil suction pipe 81 is immersed at the lower end thereof in an oil which is stored in an oil reservoir 4 formed on the inside of a lower cover 22 of the casing 1. The oil suction pipe leads to eccentric oil passage bores 82 and 83 which suck an oil through the oil suction pipe 81 by the centrifugal force caused by the rotation of the crankshaft 8, so as to feed the oil to each bearing portion 84, 85 or **9*a* through oil ports 821 or 831. A balance weight 90 is fixed to the crankshaft 8**.

Figure 2:
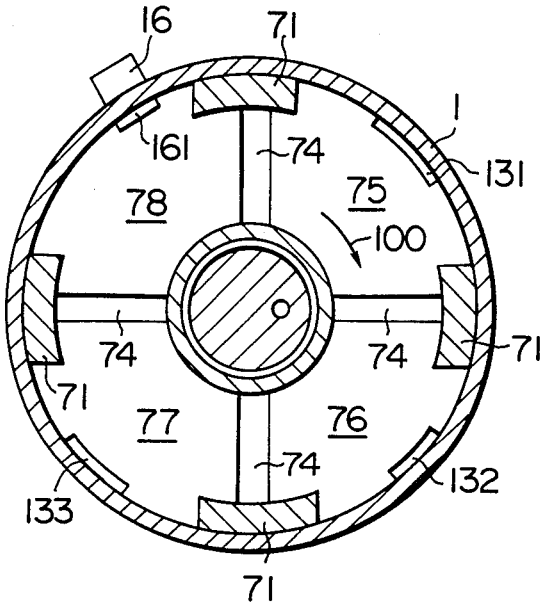
FIG. 2 is a cross-sectional view taken along the line II—II of FIG. 1.

When the crankshaft 8 is rotated by the motor section 3, the orbiting scroll member 6 performs orbiting motion with respect to the stationary scroll member 5 by the rotating crank and the revolving mechanism, so as to compress a refrigerant gas sucked from the suction pipe 11 and deliver it from the discharge port 12 into the hermetic casing 1. The thus discharged refrigerant gas flows into the lower portion of the compressor section 2 through the plurality of the passages 131, 132 and 133 which are defined between the compressor section 2 and the hermetic casing 1. At this time, the refrigerant gas flows at a low velocity along the wall of the hermetic casing and the oil in the refrigerant flows down along the inner surface of the wall of the hermetic casing 1. Furthermore, since the motor 3 is rotated in the direction of an arrow 100 of FIG. 2 so as to cause the refrigerant gas to flow in the direction of the arrow at the lower portion of the compressor section 2, the oil tends to flow in the circumferential direction as indicated by the arrow. However, since the radial ribs 74 are provided at the lower portion of the compressor section 2, the circumferential flow of oil is blocked so that the oil may not easily flow out to the exterior of the compressor from the delivery pipe 16. Thus, the radial ribs 74 prevent the oil flowing along the inner wall of the hermetic casing 1 from flowing out from the delivery pipe 16.

According to the invention as described above, it is possible to not only inexpensively separate the oil contained in the refrigerant, but also preclude the undesirable "blow up" whereby the escape of the oil to the exterior of the compressor is prevented.

What is claimed is:

1. A hermetic scroll compressor comprising: a hermetic casing; a scroll compressor section disposed in an upper portion of said hermetic casing and including a pair of scroll members each having an end plate and a scroll wrap formed on said end plate, said scroll members being assembled so that the wraps thereof mesh with each other and define closed spaces between said wraps and said end plates, said closed spaces being progressively decreased in volume when said closed spaces are moved towards a center of said compressor as a result of a relative orbiting motion between said scroll members; an electric motor section for driving said scroll compressor section disposed in a lower portion of said hermetic casing; an oil reservoir formed in a bottom portion of said hermetic casing; a delivery port formed in a portion of said hermetic casing between said compressor section and said electric motor section; and a plurality of fluid passages formed in an outer periphery of said compressor section and along an inner surface of a wall of said hermetic casing, so that a compressed fluid discharged from said compressor section in a discharge space of said hermetic casing is introduced to said delivery port through said fluid passages; a frame to which said compressor section and said electric motor section are secured, a portion of said frame between said compressor section and said electric motor section having a plurality of concave spaces formed therein comunicating with one another, one of said concave spaces being in direct communication with said delivery port while each of the other concave spaces are in communication with at least one of said plurality of fluid passages.

2. A hermetic scroll compressor comprising: a hermetic casing; a scroll compressor section disposed in an upper portion of said hermetic casing and having a pair of scroll members each including an end plate and a scroll wrap formed on said end plate, said scroll members being assembled so that the wraps mesh with each other and define closed spaces between said wraps and said end plates, said closed spaces being progressively decreased in volume when said closed spaces are moved towards a center of said compressor as a result of a relative orbiting motion between said scroll members; an electric motor section for driving said scroll compressor section disposed in a lower portion of said hermetic casing; an oil reservoir formed in a bottom portion of said hermetic casing; a delivery port formed in a portion of said hermetic casing between said compressor section and said electric motor section; and a plurality of fluid passages formed in an outer periphery of said compressor section and along an inner surface of a wall of said hermetic casing, so that a compressed fluid discharged from said compressor section in a discharge space of said hermetic casing is introduced to said delivery port through said fluid passages, wherein said compressor section and said electric motor section are secured to a common frame so as to be fixedly mounted in said hermetic casing through said frame, said frame including a plurality of motor mounting legs and a central main bearing boss formed on a side of said frame adjacent to said electric motor section, said main bearing boss and said legs are connected through a plurality of reinforcing ribs so that said ribs and said legs cooperate in defining a plurality of concave spaces communicating with one another at lower portions thereof, and said delivery portion is opened to one of said concave spaces while each of the other concave spaces is communicated at an upper portion thereof with at least one of said plurality of fluid passages.

3. A hermetic scroll compressor according to claim 2, wherein said reinforcing ribs are arranged radially.

4. A hermetic scroll compressor according to claim 1, wherein said plurality of fluid passages are arcuate passages formed along the inner surface of the wall of said hermetic casing.

5. A hermetic scroll compressor according to claim 4, wherein said plurality of fluid passages have different areas.

6. A hermetic scroll compressor according to claim 2, wherein said plurality of fluid passages are formed in arcuate forms in and along the outer periphery of said compressor section.

7. A hermetic scroll compressor according to claim 2, wherein each of said reinforcing ribs has a lower edge extending substantially horizontally to form well defined concave spaces.

* * * * *